United States Patent [19]

Hallberg et al.

[11] Patent Number: 4,648,343

[45] Date of Patent: Mar. 10, 1987

[54] BAND MAGAZINE WITH ANCHOR BAND

[76] Inventors: Håkan Hallberg, Tegelbruksvägen 186, S-46200 Vänersborg; Hans Österberg, Hôjdvôgen 11, 43080 Hovös; Einar Olander, Smedsbucksoj. 9, 11539 Stockholm, all of Sweden

[21] Appl. No.: 571,650

[22] Filed: Jan. 17, 1984

[30] Foreign Application Priority Data

Feb. 1, 1983 [SE] Sweden ..... 8300513

[51] Int. Cl.[4] ..... B63B 21/22

[52] U.S. Cl. ..... 114/210; 114/254; 242/86.5 R

[58] Field of Search ..... 114/179, 180, 210, 293, 114/294, 242, 253, 254, 243; 242/96, 105, 86.5 R, 86.5 A; 57/259, 260

[56] References Cited

U.S. PATENT DOCUMENTS

| | | | |
|---|---|---|---|
| 1,800,851 | 4/1931 | Wennerstrom . | |
| 2,501,201 | 3/1950 | Wilcox | 242/105 |
| 3,006,309 | 10/1961 | Rowley | 114/254 |
| 3,810,588 | 5/1974 | Mahoney | 242/105 |
| 3,954,226 | 5/1976 | Pickering | 242/96 |
| 3,979,833 | 9/1976 | Grundman | 242/96 |
| 4,034,556 | 7/1977 | Riber | 114/294 |
| 4,220,293 | 9/1980 | Gename | 242/96 |
| 4,266,740 | 5/1981 | Ramos et al. | 242/86.5 |
| 4,350,110 | 9/1982 | Knutson et al. | 114/243 |

OTHER PUBLICATIONS

Offshore Instruments Ltd., England, Spinlock, Oct. 19, 1984.

*Primary Examiner*—Galen L. Barefoot
*Assistant Examiner*—Stephen P. Avila
*Attorney, Agent, or Firm*—Lowe Price Leblanc Becker & Shur

[57] ABSTRACT

The invention relates to a device for attaching anchors, especially to sailing and motor boats and includes a strong, flat, flexible band which is comparatively thin in relation to its width and is attached to the anchor at one end and connected at its other end to a band magazine which comprises a reel built up of two rigidly interconnected end wall plates which are non-rotatably attachable to a convenient part of the boat. The wall plates are spaced apart from one another at a distance only slightly wider than the band width, and a rotatable sleeve which is mounted centrally on the end wall plates is rotatable by means of a crank or the like and is provided with an attachment for the band end.

10 Claims, 4 Drawing Figures

6'
1
10
9
11
3(4)
8
5
11
2
6+7

2

BAND MAGAZINE WITH ANCHOR BAND

The present invention relates to a device intended for anchors, especially in sailing and motor boats.

Cables of conventional type are used today for attachment to anchors in small-sized boats, if anchor chains are not used. To possess the required strength, such a cable must have a diameter of about 12–15 mm. The length of an anchor cable may often amount of 50 m and such cables will necessarily be bulky and also difficult to handle. Cables absorb water and must therefore be kept in a drainable place or in a tight space that will allow them to dry out. Anchoring problems often arise as the cable runs out since the cable is apt to snarl, curl and jam against protruding details on the deck, hatchway frames and the like. Various types of winding devices have earlier been proposed on which the anchor cable could be stored, but these have not met with success because they are bulky and the problems of paying out the cable still remain. A tightly wound water-soaked cable will upon drying out lie very loose on the reel due to diameter reduction and length increase which, during unwinding, may cause the cable turns to get entangled, form half hitches and lock one another. The object of this invention is to simplify and facilitate use of the cable so that winding, storing and unwinding to the length required for anchoring can take place without problems.

The novelty of the device according to this invention is that it includes a flexible band which is comparatively thin in relation to its width; has little yieldability in its longitudinal sense, and is fixable to the anchor at one end and to a band magazine at its other end, the band magazine comprises a reel built up of two end wall plates which are non-rotatably attached to a convenient part of the boat and are rigidly interconnected by means of scattered peripherally situated pins or the like and spaced from one another at a distance adapted to the band width, and a sleeve or the like which is mounted centrally on the end wall plates, is rotatable by means of a crank, lever or the like and is provided with an attachment for the band end, and that two of the pins interconnecting the end wall plates are localized at a relative distance from each other adapted to the band thickness, thus forming a guide for the band as this is being wound in or pulled out.

A preferred embodiment of the invention described more fully below with reference to the accompanying drawings, in which.

Figure 1:
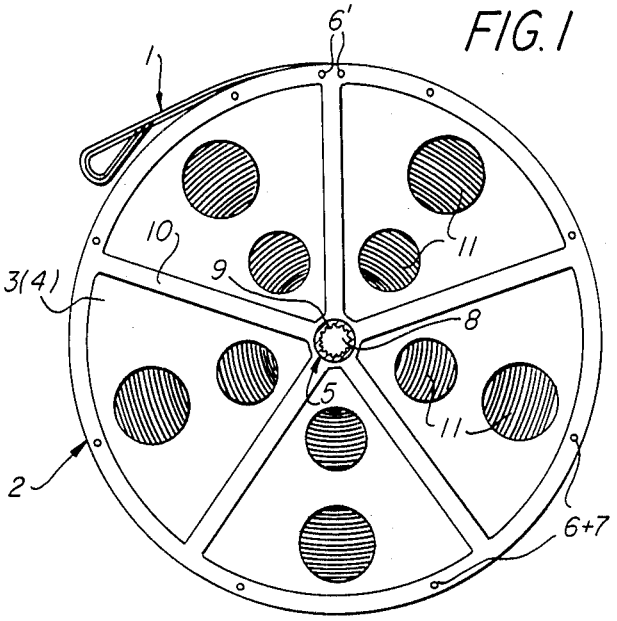
FIG. 1 is a side view of a band magazine for the anchor band.

The band 1 used preferably consists of woven artificial fibre and has a thickness that is relatively small compared to its width. The band magazine 2 according to the invention, the so-called reel, comprises two end wall plates 3 and 4 and a sleeve 5 rotatably borne therebetween.

The end wall plates 3 and 4 are provided along the periphery with bored pins 6 which serve as spacing members for the end wall plates and as guides for screws 7 with nuts holding together the end wall plates.

The rotary sleeve 5 is provided on its inside with grooves 8 adjusted to the splines that are standard in sheet winch cranks available on the market. At its ends, the sleeve 5 has circumferentially extending depressions which are adapted to run in mounting holes 9 provided at the central part of the respective end wall plates 3, and 4. The end wall plates 3 and 4 have rigidifying ridges 10 extending radially from the central part, and are also provided with a number of apertures 11. As the thickness of the material in the ridges is equal to that in the rest of the end wall plates there will be formed a number of radial channels which facilitate air circulation around the band 1 wound on the reel. The drying is also facilitated by the air coming in contact with the band via the apertures 11.

In the sleeve 5 there is an appropriately shaped attachment for the anchor band 1 which runs out of the reel between two bored pins 6' spaced from each other at a distance adapted to the band thickness.

Instead of using a sleeve with an opening fitting a sheet winch crank one may mount on the sleeve a fixed crank which preferably is foldable and in folded condition locks the sleeve. While using the sleeve it is also possible to utilize another type of turning means, e.g. a ratchet lever or even an electrically operated engine.

To permit disconnection of the band 1 from the reel if, for example, the anchor has got stuck and cannot be detached in the usual way or if somebody else's anchor cable has entangled the band, an easily detachable joint is arranged on the band at such a distance from the end attached to the sleeve as to permit detaching the band without problems. The band piece attached to the sleeve should consequently extend well beyond the reel. Conventional clamp rings or the like may be used as an appropriate jointing means.

Figure 2:
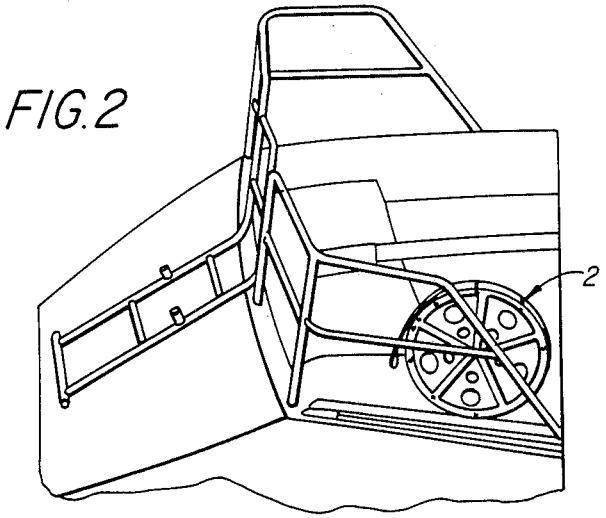
FIGS. 2, 3 and 4 show said magazine in different mounting positions.
Figure 3:
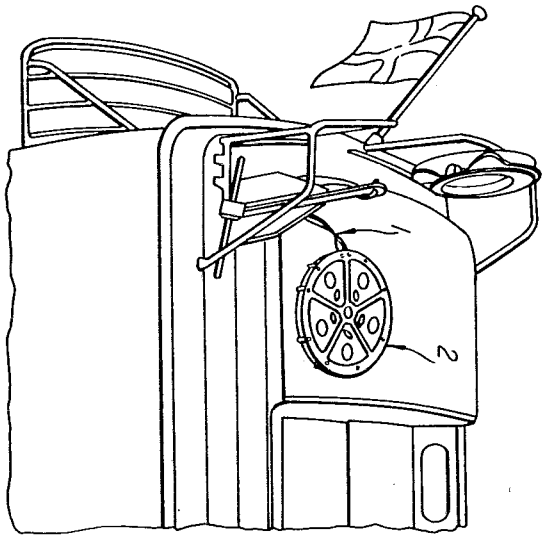
Figure 4:
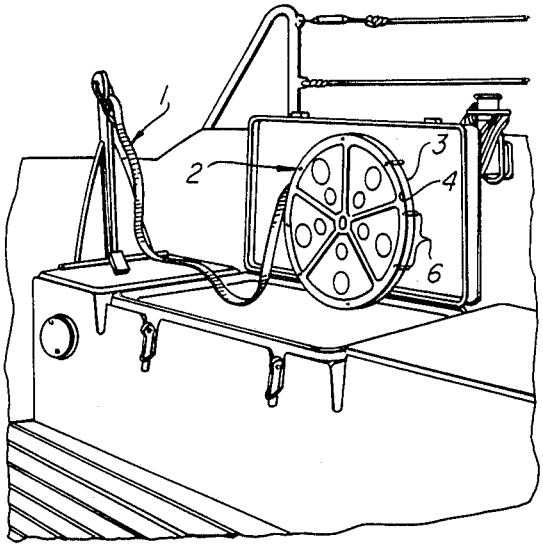

The reel or magazine 2 has an axial extent which only slightly exceeds the width of the band 1, which makes it possible to mount the reel in a simple manner at a point where it is not obstructive. In FIG. 2 it is shown how the reel 2 is mounted vertically on the gunwale, in FIG. 3 it is shown how the reel is mounted horizontally on the deck, and in FIG. 4 how the reel is mounted on the under side of an openable hatchway where it may be entirely concealed.

By using a band instead of a conventional cable many advantages are gained in addition to saving space and simplified handling. A band may be allowed to run out past a closed hatchway without being damaged. A band will not be damaged if it is twined during anchoring. A band tightened around a cleat or the like can - unlike a cable - be detached also in wet condition.

The reel or magazine 2 is secured to the base by means of perforated sheet iron, clamps or the like, which are fixed to the reel by unscrewing and replacing some of the screws 7 by longer screws which, via a suitable spacing tube, are passed through the sheet iron or the like.

It may finally be pointed out that the reel is not intended for use as a capstan but the anchor is pulled up in the usual way, whereupon the unloaded cable is wound up.

The invention should not be considered restricted to the embodiments described above and shown in the drawings but may be modified in various ways within the scope of the appended claims.

What we claim and secure by Letters Patent is:

1. An apparatus for conveniently attaching an anchor to a boat, comprising:

a strong flexible flat anchor band having a thickness considerably smaller than its width, for attachment at a first end to an anchor of said boat; and band retaining means providing a fixed space only slightly wider than said anchor band, said fixed space being defined by two parallel end plates non-rotatably attached to said boat, for retaining a wound-up length of said anchor band therein, attached to a second end of said anchor band and attached to said boat.

2. An apparatus as claimed in claim 1, wherein:

said anchor band has a high yield strength and low elasticity along its length.

3. An apparatus as claimed in claim 2, wherein:

said anchor band is made of woven fibers in a manner such that it has no innate tendency to twist upon the application of or release from a tensile load.

4. An apparatus as claimed in claim 1, wherein:

said anchor band retaining means comprises a connecting means for connecting to said second end of said anchor band.

5. An apparatus as claimed in claim 4, wherein:

said band retaining means comprises two parallel end plates non-rotatably attached to said boat, said end plates being rigidly interconnected a predetermined distance apart by peripherally located spacers, said predetermined distance being slightly greater than said width of said anchor band;

a rotatable band winding means, located between said parallel end plates and rotatable by an applied torque, for winding thereon said anchor band, the rotational axis of said winding means being positioned normal to said parallel end plates and substantially centrally thereof;

two fixed rigid guide pins normal to and attached to said end plates, located at a distance from said rotational axis and spaced apart so as to guide said anchor band therebetween during winding and unwinding thereof without twisting.

6. An apparatus as claimed in claim 5, wherein:

said end plates are provided with apertures to facilitate air access to the interspace between said end plates.

7. An apparatus as claimed in claim 5, wherein:

said end plates are formed with channels, directed to have a radial component, to facilitate air access to the interspace between said end plates.

8. An apparatus as claimed in claim 5, wherein:

said band retaining means comprises a separate flexible flat connecting band, attached at a fixed end thereof to said rotatable band winding means and having a length such that its other end extends by a predetermined margin past said guide pins;

band-to-band connecting means attached to said other end of said connecting band for connecting with said second end of said anchor band attached at said first end thereof to said anchor.

9. An apparatus as claimed in claim 5, further comprising:

torque application means for engagement with said rotatable band winding means for applying torque thereto for winding thereon said anchor band.

10. An apparatus as claimed in claim 9, wherein:

said torque application means comprises a crank engageable with said band winding means in a conventional manner.

* * * * *